US009541327B2

(12) United States Patent
Lu et al.

(10) Patent No.: US 9,541,327 B2
(45) Date of Patent: Jan. 10, 2017

(54) ICE DISPENSER FOR A REFRIGERATION DEVICE

(75) Inventors: Songtao Lu, Chuzhou (CN); Alexander Rupp, Nanjing (CN); Lisheng Zhang, Chuzhou (CN)

(73) Assignee: BSH Hausgeräte GmbH, Munich (DE)

( * ) Notice: Subject to any disclaimer, the term of this patent is extended or adjusted under 35 U.S.C. 154(b) by 1333 days.

(21) Appl. No.: 13/058,883

(22) PCT Filed: Mar. 11, 2009

(86) PCT No.: PCT/EP2009/052825

§ 371 (c)(1),
(2), (4) Date: Feb. 14, 2011

(87) PCT Pub. No.: WO2010/022989

PCT Pub. Date: Mar. 4, 2010

(65) Prior Publication Data

US 2011/0138841 A1 Jun. 16, 2011

(30) Foreign Application Priority Data

Aug. 29, 2008 (DE) ..... 10 2008 044 897

(51) Int. Cl.

| | |
|---|---|
| ***F25C 1/04*** | (2006.01) |
| ***F25C 1/08*** | (2006.01) |
| ***F25D 11/02*** | (2006.01) |
| ***F25D 17/04*** | (2006.01) |
| ***F25D 23/12*** | (2006.01) |
| ***F25C 5/00*** | (2006.01) |
| ***F25C 5/04*** | (2006.01) |
| ***F25C 5/18*** | (2006.01) |

(52) U.S. Cl.

CPC ..... *F25D 23/12* (2013.01); *F25C 5/007* (2013.01); *F25C 5/04* (2013.01); *F25C 5/185* (2013.01); *F25C 5/187* (2013.01); *F25C 2400/10* (2013.01); *F25C 2500/08* (2013.01); *F25C 2700/02* (2013.01); *F25D 2317/061* (2013.01)

(58) Field of Classification Search

CPC ..... F25C 1/04; F25C 5/06; F25C 2305/022; F25C 2400/10; F25C 2400/06; F25C 5/182; F25D 2317/062; F25D 23/04; F25D 2323/023; F25D 2323/122; F25D 2400/06

USPC ..... 62/340, 344

See application file for complete search history.

(56) References Cited

U.S. PATENT DOCUMENTS 3,952,539 A * 4/1976 Hanson ..... F25C 1/04 62/351
6,742,353 B2 * 6/2004 Ohashi ..... F25D 17/04 62/405

(Continued)

FOREIGN PATENT DOCUMENTS

DE 202004016966 U1 4/2006
DE 102006017803 A1 10/2007

(Continued)

*Primary Examiner* — Frantz Jules
*Assistant Examiner* — Meraj A Shaikh
(74) *Attorney, Agent, or Firm* — Nixon & Vanderhye P.C.

(57) ABSTRACT

An ice dispenser for a refrigerator is provided. The ice dispenser includes an ice storage container housing and an ice generator having a hollow mold which is filled with water. The ice storage container housing and the ice generator are combined into one modular unit.

24 Claims, 7 Drawing Sheets

(56) References Cited

U.S. PATENT DOCUMENTS

| | | | | |
|---|---|---|---|---|
| 7,204,092 | B2 * | 4/2007 | Azcarate Castrellon | F25C 1/04 249/118 |
| 7,509,818 | B2 * | 3/2009 | Anselmino | F25C 5/182 62/344 |
| 7,614,244 | B2 * | 11/2009 | Venkatakrishnan | F25D 17/065 62/187 |
| 8,196,418 | B2 * | 6/2012 | Kim | F25C 1/04 62/127 |
| 8,683,822 | B2 * | 4/2014 | Kang | F25C 1/04 62/344 |
| 2006/0112715 | A1 * | 6/2006 | Chung | F25C 1/10 62/340 |
| 2006/0260345 | A1 * | 11/2006 | Coulter | F25D 11/02 62/340 |
| 2006/0260351 | A1 * | 11/2006 | Coulter et al. | 62/407 |
| 2006/0266067 | A1 * | 11/2006 | Anderson | F25C 1/04 62/340 |
| 2007/0089441 | A1 * | 4/2007 | Ito | F25C 1/22 62/135 |
| 2007/0227176 | A1 | 10/2007 | Anell et al. | |
| 2008/0148762 | A1 | 6/2008 | Guarino et al. | |
| 2009/0049858 | A1 * | 2/2009 | Lee | F25C 1/08 62/349 |
| 2010/0161137 | A1 * | 6/2010 | Kim | F25C 1/04 700/282 |

FOREIGN PATENT DOCUMENTS

| | | | | |
|---|---|---|---|---|
| KR | WO2008020707 | A1 | 2/2008 | |
| KR | WO 2008082129 | A1 * | 7/2008 | F25C 5/185 |
| KR | WO2008082129 | A1 | 7/2008 | |
| WO | WO 2008082129 | A1 * | 7/2008 | |

* cited by examiner

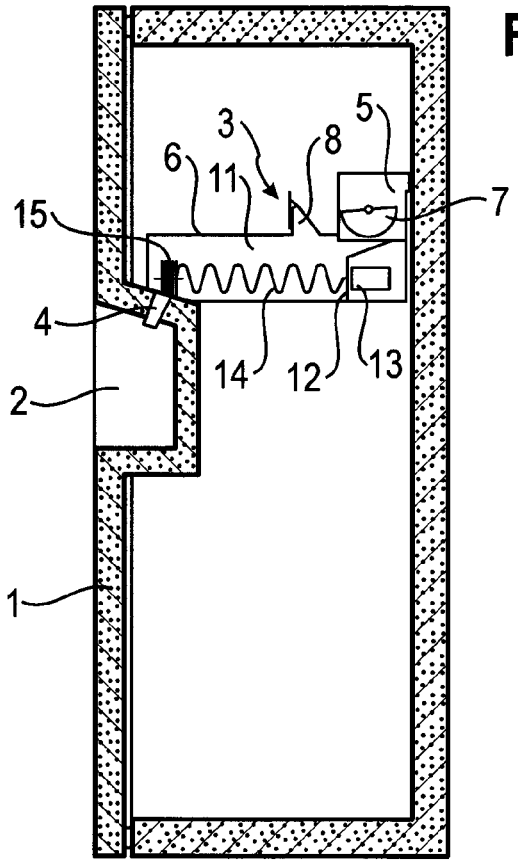
Fig. 1
Fig. 2
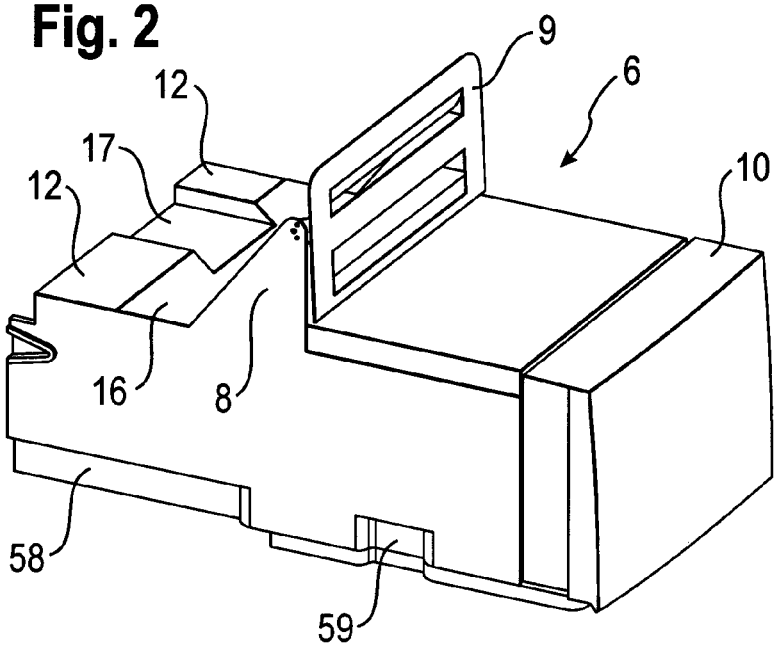

ICE DISPENSER FOR A REFRIGERATION DEVICE

This application is a U.S. National Phase of International Patent Application No. PCT/EP2009/052825, filed Mar. 11, 2009, which designates the U.S. and claims priority to German Patent Application No. DE 10 2008 044 897.4, filed Aug. 29, 2008, the entire contents of each of which are hereby incorporated by reference.

BACKGROUND OF THE INVENTION

The present invention relates to an automatic ice dispenser for mounting within a refrigeration device, in particular a domestic refrigeration device, and to a refrigeration device fitted with such an icemaker. Conventionally, such an ice dispenser comprises two functional groups, namely the actual ice generator, which comprises at least one cooled hollow mold and optionally means for metering water into the hollow mold and for ejecting the finished pieces of ice, and an ice storage container in which the finished pieces of ice are stored until use, optionally with means for ejecting the pieces of ice out of the container.

These two functional groups are each mounted separately in a refrigeration device. If they are not used, they should be easily removable by a user, and their reinstallation should also be possible conveniently and safely. One problem here is that the ice generator generally has significantly smaller dimensions than the ice storage container and tends to be mounted at a rather inaccessible point close to the back wall in a refrigeration device. This makes its installation and removal difficult. For a user who needs space in the refrigeration device temporarily, it is simplest to remove just the ice storage container and to leave the ice generator in place. This is unsatisfactory, because the ice generator cannot be used and is merely taking up space. In order to ensure that the ice generator does not produce any ice when the ice storage container is not there to receive it, a sensor has to be provided which automatically switches off the ice generator in the absence of the ice storage container.

BRIEF SUMMARY OF THE INVENTION

The object of the present invention is to provide an ice dispenser which is easier to install and remove and in which there is no risk of the ice generator operating in the absence of the ice storage container.

The object is achieved firstly in that, in an ice dispenser comprising an ice storage container housing and an ice generator which comprises at least one hollow mold which can be filled with water, the ice storage container housing and the ice generator are combined into one modular unit. In this way, both can be installed and removed together, and the outlay associated with the installation and removal of the ice generator no longer applies. Since the ice generator is always taken out together with the ice storage container housing, there is no need for any means to prevent operation of the ice generator in the absence of the ice storage container.

In order to ensure that the ice storage container housing and the ice generator are assembled correctly, the two can have intermeshing contours which, if possible, permit assembly only in a single configuration.

For cooling the hollow mold, a cold-air duct can be provided on the ice generator. This cold-air duct preferably has an outlet opening which opens into the ice storage container housing so that the air guided through the duct can also cool the stored ice downstream of the hollow mold.

The intermeshing contours can in particular be formed in that a wall of the ice generator, said wall delimiting the cold-air duct, engages with a complementary recess of the ice storage container housing.

The cold-air duct preferably runs beneath the hollow mold. In this way, firstly, the hollow mold is cooled efficiently and, secondly, the cold air, after passing the hollow mold without being diverted substantially, can pass into the ice storage container, which is preferably arranged somewhat lower than the hollow mold so that ice from the hollow mold can pass under the effect of gravity into the ice storage container.

The ice storage container housing and the ice generator are preferably fastened to a common support member. The common support member may in particular form a back wall of the ice dispenser.

An upstream portion of the cold-air duct, via which cold air can be fed to the ice generator, may usefully be formed on the support member.

If the support member is a back wall of the ice dispenser, then it is useful if the upstream portion is delimited on the one hand by the back wall of the ice dispenser and on the other by a back wall of the refrigeration device housing.

To seal the upstream portion, a wall of the upstream portion may usefully be formed by two adjacent ribs and a sealing strip inserted into an intermediate space between the ribs. This sealing strip may tightly adjoin the back wall of the refrigeration device or another suitable wall surface.

The ice storage container housing is preferably divided into a first cavity for accommodating the ice and a second cavity in which a drive motor of a conveyor tool, which is arranged in the first cavity and serves to eject the ice out of the storage container, is arranged.

This second cavity may be closed off by the support member, for example in order to protect the motor or other components installed in the second cavity from moisture.

For ejecting ice out of the hollow mold, the ice generator preferably has a pusher which can be moved through the hollow mold. This eliminates the need to move the hollow mold itself to eject the ice, and space which would otherwise have to be kept free for the movement of the hollow mold can be used for other purposes.

Between two hollow molds, an inclined surface sloping toward the ice storage container can be provided, onto which inclined surface pieces of ice pushed out of the hollow mold by the pusher can fall in order to slide down from there into the ice storage container.

A level sensor crossing an inlet opening of the ice storage container can be movably provided. When movement of the level sensor is obstructed by ice, the holding capacity of the ice storage container is exhausted. In this case, the ice generator has to be switched off.

A further object of the invention is a refrigeration device comprising an ice dispenser of the type described hereinabove, to the housing of which the ice generator is connected indirectly via the ice storage container housing or via a support member shared with the ice storage container housing. Since the ice generator cannot be mounted in the refrigeration device without the ice storage container housing, there is no possibility of it being operated inadvertently without it being possible for the ice produced to be received by the ice storage container.

BRIEF DESCRIPTION OF THE DRAWINGS

Further features and advantages of the invention will emerge from the description of exemplary embodiments hereinbelow referring to the enclosed figures, in which:

FIG. 1 shows a schematic section through a refrigeration device comprising an automatic ice dispenser;

FIG. 2 shows a perspective view of an ice storage container housing of the ice dispenser;

DETAILED DESCRIPTION OF EXEMPLARY EMBODIMENTS OF THE PRESENT INVENTION

Figure 3:
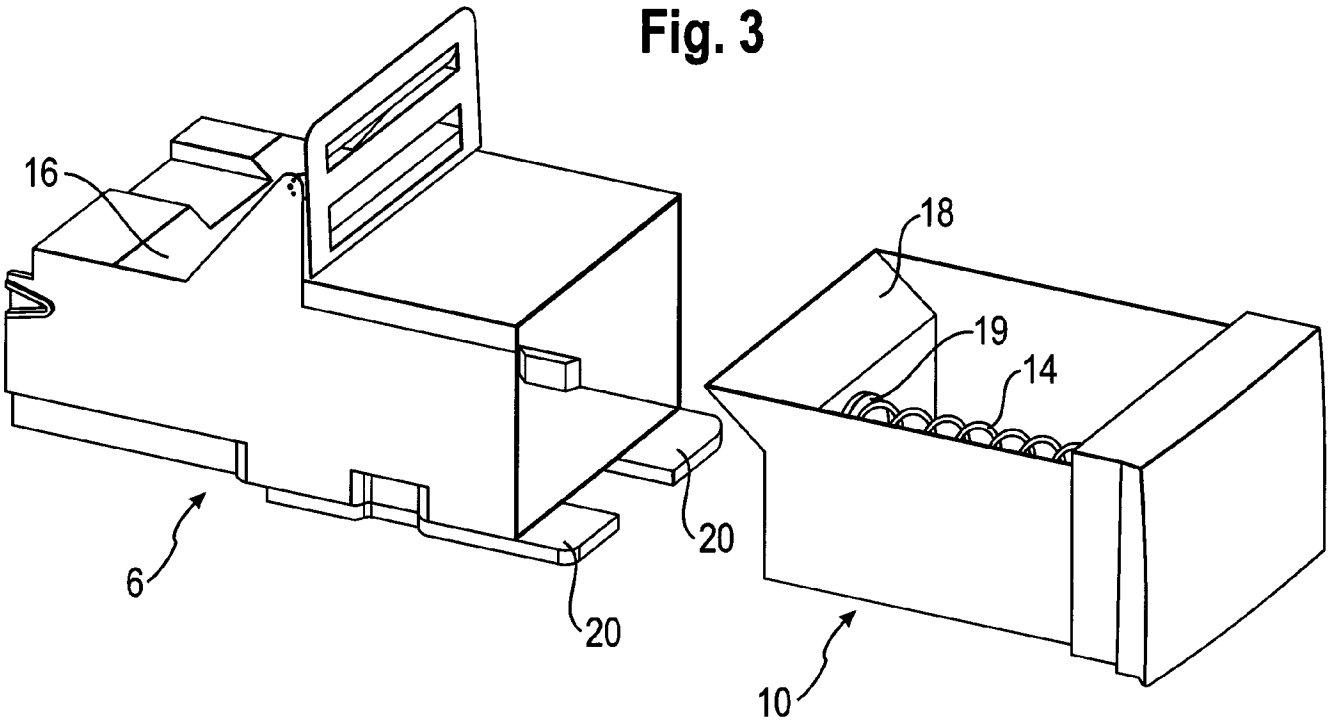
FIG. 3 shows a perspective view of the ice storage container housing in exploded position.

FIG. 1 shows a schematic section through a refrigeration device comprising an integrated automatic ice dispenser 3. A recess 2 in which a vessel to be filled can be placed is formed in a door 1 of the refrigeration device in a manner known per se. The refrigeration device is the same height as a man or taller, but the recess 2 should, in order to enable convenient handling, be arranged no higher than the chest height of a user. In order to be able to fill a vessel (not shown) placed in the recess 2 with pieces of ice out of the ice dispenser 3 via a passage 4 formed in the wall of the recess 2, the ice dispenser 3 should be placed immediately above the recess 2 and extend in a depth direction as far as and over the recess 2.

The ice dispenser 3 essentially comprises two modules connected via a common back wall: an ice generator 5, in which pieces of ice are produced, and an ice storage container housing 6, in which they are stored until use.

The ice generator 5 includes a tray 7 in which a plurality of hollow molds having a circular-sector-shaped or semi-cylindrical cross section are formed. Finished pieces of ice which are ejected from the hollow molds by a drive mechanism (to be described in greater detail later) drop over a front edge of the tray 7 down into a storage chamber which fills a large part of the ice storage container housing 6. A motor 13 for driving a conveyor spiral 14, which extends through the storage chamber, and a grinder 15, which is arranged immediately above the passage 4, is accommodated in a second chamber of the ice storage container housing 6.

FIG. 2 shows a perspective view of the ice storage container housing 6, seen obliquely from the front. The ice storage container housing 6 is substantially cuboid in shape, having two triangular arms 8, which support a pivotable flap 9, projecting upwardly on the sides. An opening through which a storage chamber in the interior can be accessed is formed behind the flap 9 in the top of the ice storage container housing 6. A drawer 10 which can be pulled out in a forward direction is housed in the storage chamber.

Forming the rear area of the ice storage container housing 6 is a chamber, open to the rear, of which a cover 12 and a partially obliquely sloping front wall 16 can be seen in FIG. 2. In the cover 12, a planar recess 17 extends along the front-back axis of the refrigeration device. When the ice dispenser is completely assembled, the ice generator 5 is mounted on the cover 12, the front edge of the tray 7 of the ice generator being positioned such that the pieces of ice ejected from it fall through the opening of the ice storage container housing 6 on to the obliquely sloping wall 16 or directly into the drawer 10.

Formed on the lower edge of each side wall of the ice storage container housing 6 are two recesses 58, 59 which are provided in order to receive ribs projecting from side walls of the body of the refrigeration device and in this way anchor the housing 6 in the body.

FIG. 3 shows the ice storage container housing 6 with the drawer 10 pulled out. A back wall 18 of the drawer 10 is partially sloping, in a manner complementary to the wall 16, so as to catch the falling pieces of ice and to guide them into the drawer 10.

Formed in a vertical region of the back wall 18 is a circular opening in which a flatly cylindrical coupling piece 19 is rotatably held. The conveying spiral 14 engages non-rotatably with the coupling piece 19 on the front side thereof. On a rear side of the coupling piece 19 (which cannot be seen in FIG. 3), a recess such as a recessed square is formed which can be placed non-rotatably on an axial connecting piece of the motor 13. In this way, when the drawer 10 is in the pushed-in position, the conveying spiral 14 is coupled to the motor 13, but if required, e.g. if the contents of the drawer are frozen together so solidly that the spiral 14 can no longer rotate, the drawer 10 can be pulled out together with the spiral 14 in order to thaw them out.

Rotating the spiral 14 pushes the ice pieces in the drawer 10 to a dispensing opening (not visible in the figure) at the front end of the drawer. When the drawer is in the pushed-in position (FIG. 2), this dispensing opening overlaps with an intermediate space between two fingers 20, shown in FIG. 3, projecting beyond a front edge of the ice storage container housing 6. A flap on the dispensing opening is adjustable between a position in which it blocks the access of pieces of ice to the grinder and ice pieces can pass through the dispensing opening uncrushed, and a position in which it releases the access to the grinder 15 and blocks the dispensing opening for uncrushed pieces of ice.

Figure 4:
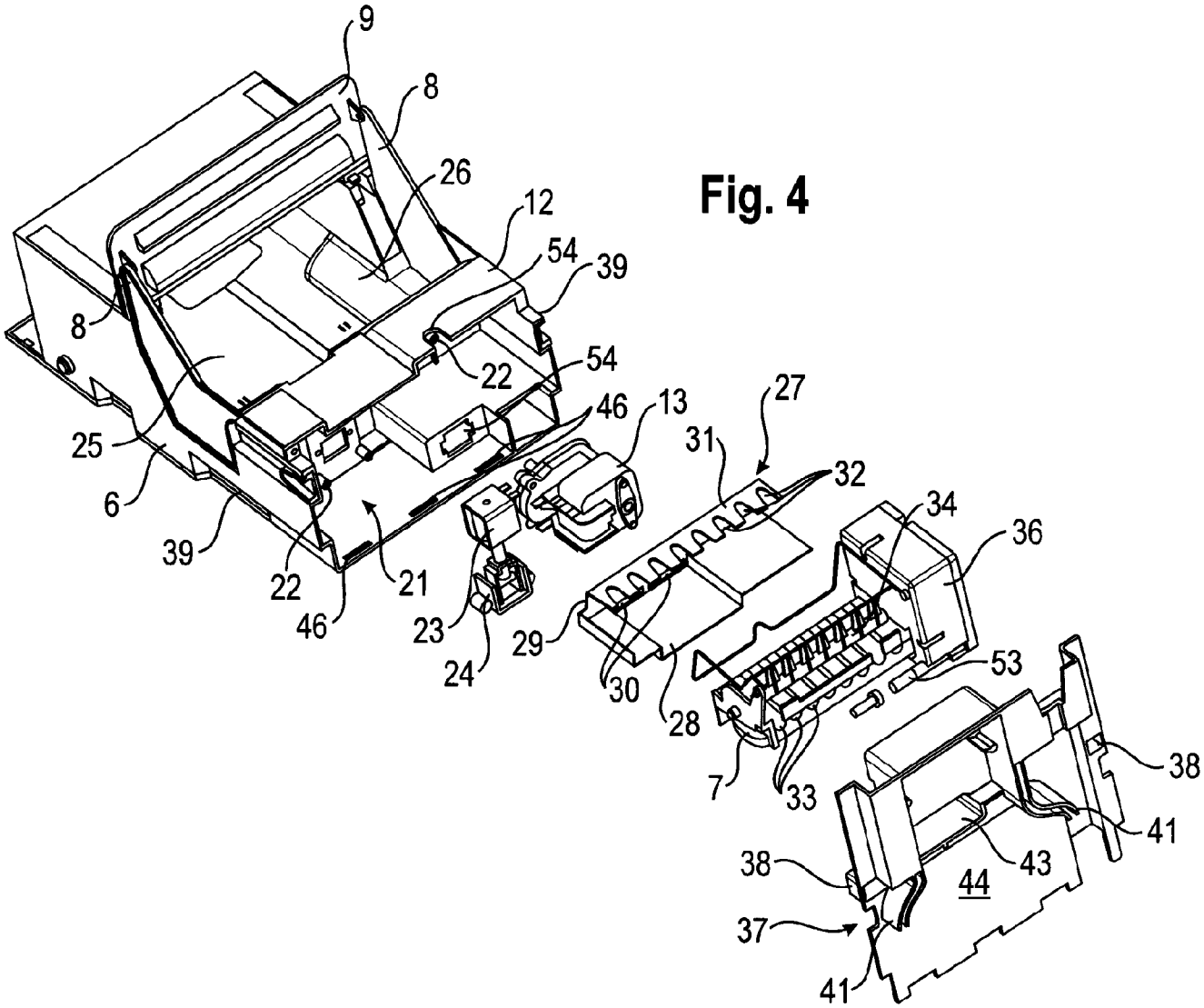
FIG. 4 shows an exploded view of the ice dispenser.

FIG. 4 shows obliquely from the rear an exploded view of the components of the ice dispenser with the exception of the drawer 10. The chamber of the ice storage container housing 6 provided for accommodating the motor 13 is visible in this view and is labeled 21. Through the open rear side of the chamber 21, in the interior thereof, can be seen a plurality of screw bosses 22 which indicate precisely and clearly the installation position of the motor 13 and of an electromagnet 23 as well as of a lever mechanism 24 controlled by the electromagnet 23. The electromagnet 23 is provided in order to control the position of the flap on the dispensing opening via the lever mechanism 24 and a rod originating from said lever mechanism and running under a base plate 25 of the storage chamber toward the front.

Two indentations 26, one of which is visible in FIG. 4, are formed beneath the arm 7 in the base plate 25. These indentations 26 are provided in order for a lighting means to be installed under each for illuminating the interior of the refrigeration device beneath the ice dispenser.

The motor 13 and the electromagnet 23 are followed in the representation of FIG. 4 by a flat plastic shell 27. It is provided in order to be positioned on the cover 12 of the chamber 20 and has on its base a planar depression 28 complementary in shape to the recess 17 of the cover 12. A front wall 29 (facing away from the viewer in the perspective shown in FIG. 4) of the shell 27 is breached at the level of the depression 28, here by two elongated slots 30.

A slightly forwardly sloping inclined surface 31 furnished here on its back edge with eight notches 32 in total is joined to the top edge of the front wall 29.

The shell 27 is provided in order to receive the previously mentioned tray 7 while maintaining an air gap between the underside of the tray 7 and the base of the shell 27. The tray 7 comprises eight hollow molds 33, corresponding to the number of notches 32, which are substantially semi-cylindrical in cross section. A shaft 34, on which eight fingers 35 (see FIG. 8) are arranged in a comb-like manner, extends along the common cross-sectional axis of the hollow molds 33. Accommodated in a housing 36 rigidly connected to the tray 7 is a drive motor for the shaft 34 and a control circuit which controls the filling of the hollow molds 33 with water, the switching on of an electrical heating device integrated in the tray 7 for thawing the surface of the ice pieces in the hollow molds after the water in the hollow molds 33 has frozen and after said thawing the ejection of the ice pieces, which can move slightly on the water layer that has been produced, out of the hollow molds 33 by rotation of the shaft 34. A power supply cable 53 of the housing 36 is provided in order to be introduced through an open-edged cutout 54 in the cover 12 into the chamber 21 and connected there to a distributor via which the motor 13 is also supplied with power.

Figure 5:
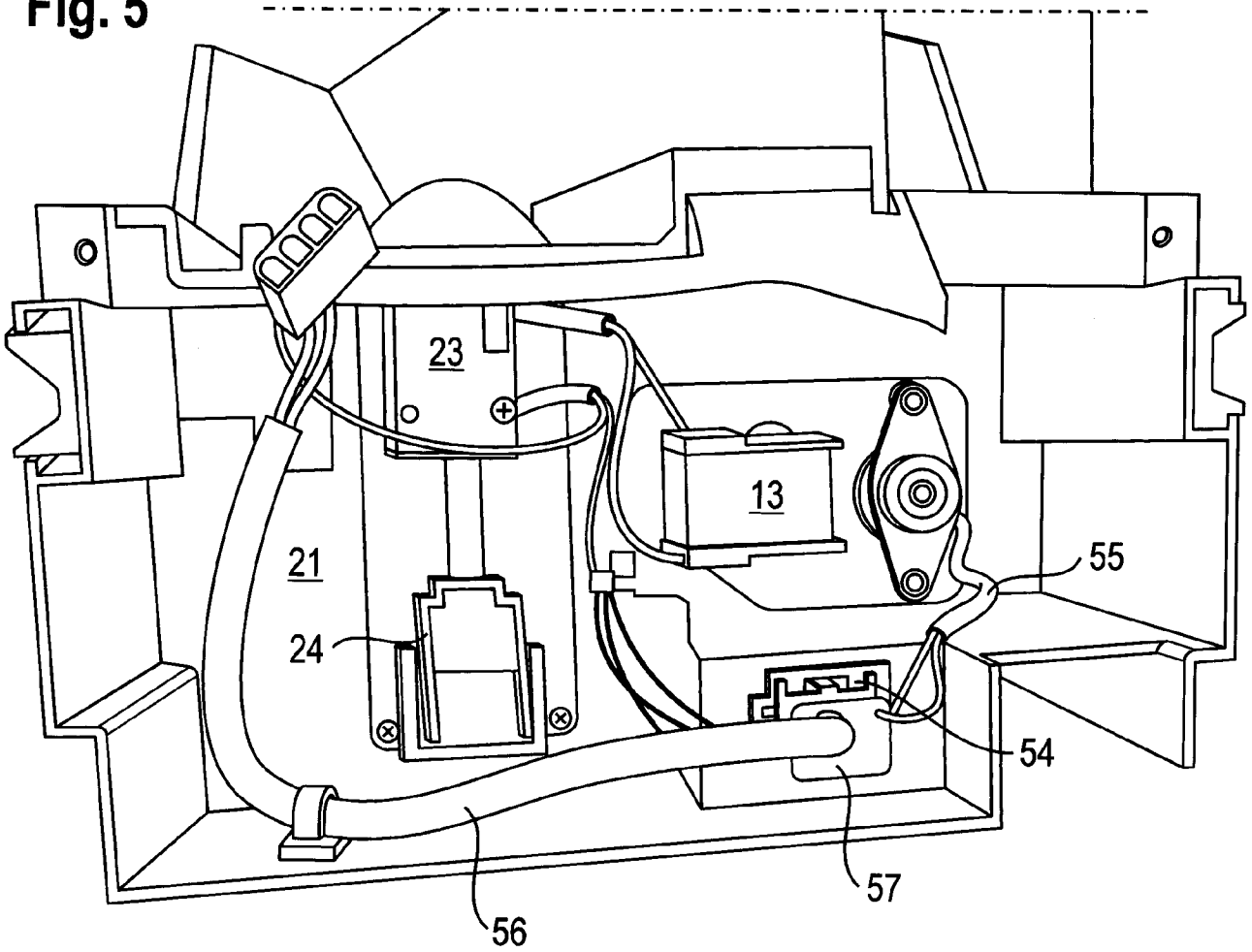
FIG. 5 shows a back view of the ice storage container housing.

FIG. 5 shows a view into the chamber 21 of the ice storage container housing. The motor 13, the electromagnet 23 and the lever mechanism 24 are screwed to screw bosses indicating their respective positions. Locked in a housing opening 54 is a plug-in connector 57 from which supply lines 55 to the motor 13 and 56 for connecting to the power supply cable 53 emerge.

Figure 6:
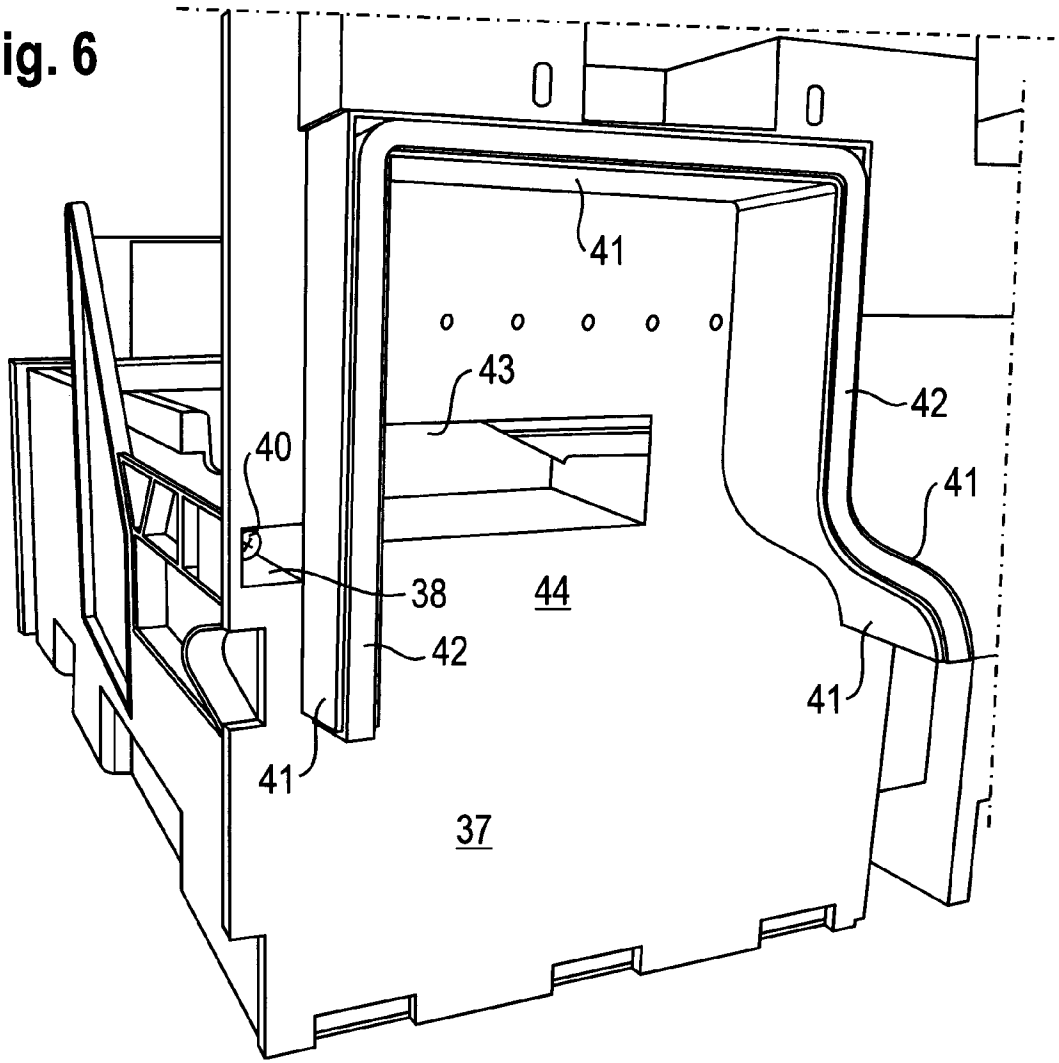
FIG. 6 shows a back wall of the ice dispenser.

A back wall 37 of the ice dispenser is shown in FIG. 4 and—in a slightly modified embodiment—in FIG. 6, in each case viewed from the rear. An approximately cuboid hollow projection 38 is formed on the right-hand and the left-hand edge respectively of the back wall 37, said projection engaging, when the ice dispenser is assembled, with a complementary receptacle 39 of the ice storage container housing 6. The back wall 37 and the ice storage container housing 6 are held together by screws 40 which are introduced from behind into the hollow projections 38 and engage with the thread of the ice storage container housing 6.

Ribs 41 projecting from the rear side of the back wall 37 delimit a cold-air duct 44 which is fed by an evaporator (not shown) arranged below the ice dispenser 3 in the refrigeration device. The ribs 41 are each arranged in pairs and delimit a groove in which a flexible sealing strip 42 is clamped. The sealing strip projects beyond the ribs 41 toward the back wall of the body of the refrigeration device so that when installed it touches this back wall and in this way seals off the cold-air duct 44.

An opening 43 formed between the ribs 41 in the back wall 37 opens into the depression 28 of the shell. In FIG. 5, the intermediate space between the base of the shell 27 and the underside of the tray 7 can be seen through the opening 43. Air blown into the cold-air duct 44 at the evaporator is forced to pass through the opening 43 and the intermediate space. The tray 7 is thereby cooled intensively such that its contents freeze in a short time.

A large part of the air blown in leaves the intermediate space via the slots 30 in the front wall 29 of the shell 27. Since the slots lie below the level of the cover of the ice storage container housing 6, the air passing through is for the most part guided into the drawer 10 and keeps the ice pieces stored therein frozen.

Figure 7:
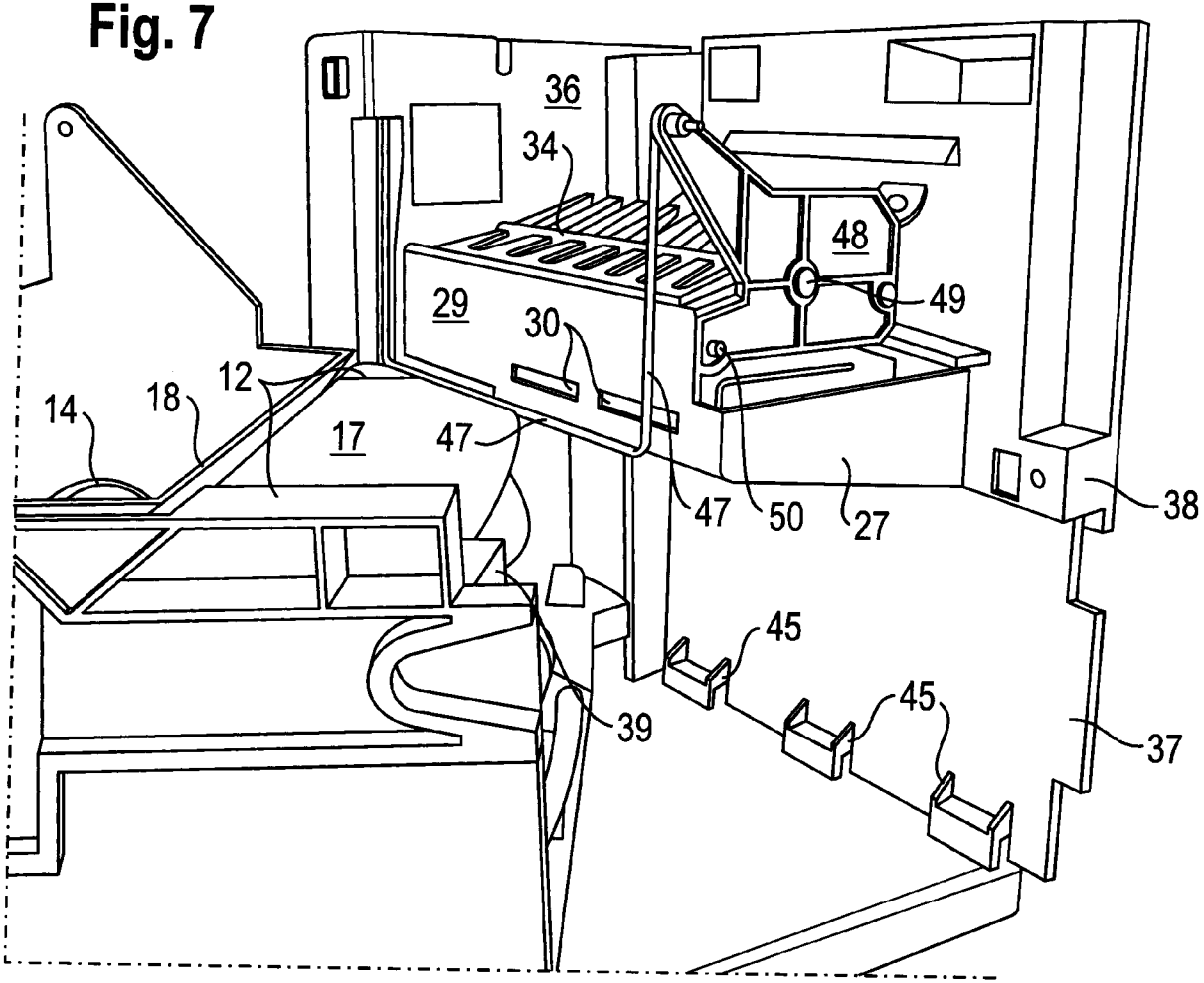
FIG. 7 shows the ice dispenser with back wall pivoted away from the ice storage container housing.

FIG. 7 shows a partial view of the rear area of the ice dispenser with the back wall 37 separated from the ice storage container housing 6 and facing away sideways. On the lower edge of the back wall 37 a plurality of hooks 45 can be seen which, when the ice dispenser is assembled, engage with the slots 46 (see FIG. 4) in the base plate of the ice storage container housing 6. These hooks 45, together with the projections 38 and receptacles 39 that are screwed to one another, suffice to connect the back wall 37 securely and free of play to the ice storage container housing 6.

In front of the front wall 29 of the shell 27 a wire bracket 47 can be seen which is suspended on the one hand in the motor and circuit housing 36 and on the other in a frame plate 48 which is in turn screwed to a narrow side of the shell 7 facing away from the housing 36. The wire bracket 47 is connected in the housing 36 to a motor and to a switch. The control circuit is configured to raise the wire bracket 47 with the aid of the motor before each ejection of ice from the shell and to lower it again after each ejection. If with the aid of the switch it is detected that the wire bracket 47 does not reach the rest position shown in FIG. 7 again, then it must be assumed that the drawer 10 is filled to capacity with ice pieces and that these are blocking the wire bracket 47. The operation of the ice generator 5 is then interrupted until such time as the wire bracket 47 has reached the rest position again.

The frame plate 48 also forms a bearing 49 for the shaft 34 and supports a spring-loaded pin 50 which engages with a small hole on a side cheek of the shell 27. When the pin 50 is pressed against the force of the spring into the frame plate 48, the shell 27 can be pulled down in a forward direction from a rib of the back wall 37 (hidden in the Figure), which supports it on its rear edge, and removed.

Figure 8:
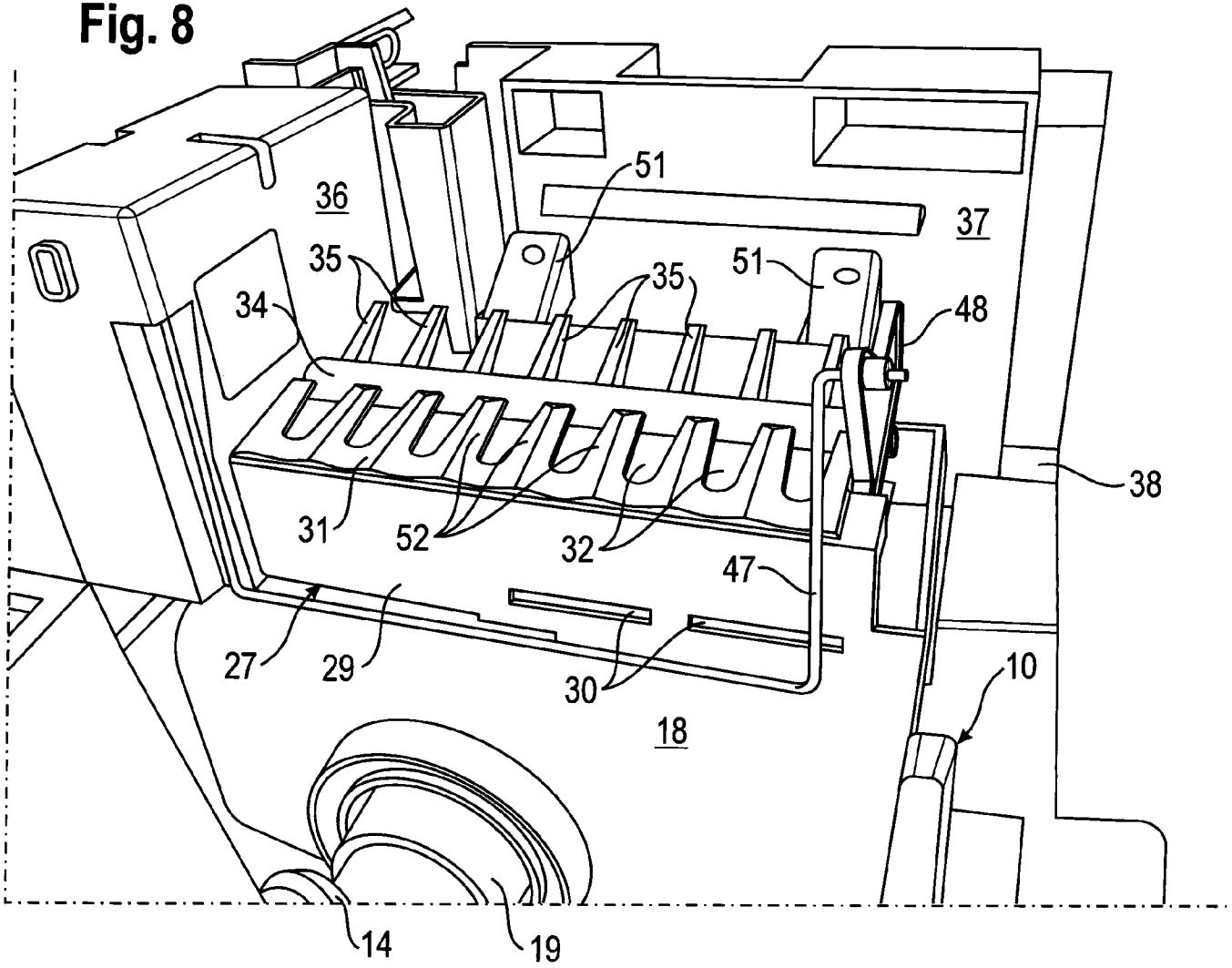
FIG. 8 shows a perspective view of the ice generator.

FIG. 8 shows a front view of the ice generator. The tray 7 is largely concealed under the inclined surface 31 of the shell 27 and the shaft 34 with its fingers 35. Two feet 51 of the tray 7 which are screwed to the back wall 37 can be seen clearly. These feet fix not only the tray 7 to the back wall 37 but also the housing 36 which is rigidly connected to the tray. The housing 36 also rests on the cover 12 and on one of the projections 38 of the back wall 37.

The ice generator 5 and the storage container housing 6 are combined mechanically via the back wall 37 to form a unit which can be inserted into the refrigeration device and removed again only as a whole. As a consequence of the shared electrical supply of the motor 13 and of the components in the housing 36 via the plug-in connector 57, the electrical connections for both functional groups can also be established and disconnected again in a single action.

With the aid of the view shown in FIG. 8, it can readily be seen that when the fingers 35 are pivoted into the semicylindrical hollow molds of the tray 7, the ice pieces will be pushed out through the notches 32 of the inclined surface 31. The fingers 35 are shaped asymmetrically so that the ice pieces, once they have passed sufficiently far through the notches 32, tilt away to the side and come to lie on the fingers 52 of the inclined surface 31. From there they slide forward and drop into the drawer 10.

The invention claimed is:

1. An ice dispenser for making and storing ice and for locating in a freezer compartment of a domestic appliance, the ice dispenser comprising:

an ice storage container housing;

an ice storage container for storing the ice made by the ice dispenser, the ice storage container being removable from the ice storage container housing; and an ice generator having a hollow mold which is filled with water to make the ice, wherein the ice storage container housing and the ice generator are combined into one modular unit that is configured to be removable from the freezer compartment of the domestic appliance, and the one modular unit is configured such that a cooling function of the freezer compartment remains operational when the one modular unit is removed from the freezer compartment.

2. The ice dispenser of claim 1, wherein the ice storage container housing and the ice generator have intermeshing contours.

3. The ice dispenser of claim 1, wherein the ice generator has a cold-air duct with an outlet opening that opens into the ice storage container housing.

4. The ice dispenser of claim 3, wherein the ice generator has a wall that delimits the cold-air duct and that engages with a complementary recess of the ice storage container housing.

5. The ice dispenser of claim 3, wherein the cold-air duct runs beneath the hollow mold.

6. The ice dispenser of claim 1, wherein the ice storage container housing and the ice generator are fastened to a common support member.

7. The ice dispenser of claim 6, wherein the ice generator has a cold-air duct with an upstream portion, and the upstream portion of the cold-air duct is formed on the common support member.

8. The ice dispenser of claim 7, wherein the upstream portion has a wall that is formed by two adjacent ribs and a sealing strip that is inserted into an intermediate space between the ribs.

9. The ice dispenser of claim 6, further comprising a back wall that is formed by the common support member.

10. The ice dispenser of claim 1, wherein the ice storage container has a first cavity and a second cavity, wherein the first cavity accommodates ice, a conveying tool is mounted in the first cavity, and a drive motor of the conveying tool is arranged in the second cavity.

11. The ice dispenser of claim 1, wherein the ice generator has a pusher to eject ice out of the hollow mold, and the pusher is movable through the hollow mold.

12. The ice dispenser of claim 11, wherein an inclined surface sloping toward the ice storage container is arranged between two hollow molds.

13. The ice dispenser of claim 1, wherein a movable level sensor crosses an inlet opening of the ice storage container.

14. A domestic refrigerator comprising:

a housing containing a freezer compartment; and an ice dispenser located in the freezer compartment and having an ice storage container housing and an ice generator with a hollow mold that is filled with water, wherein the ice storage container housing and the ice generator are combined into one modular unit that is removable from the freezer compartment of the domestic refrigerator, a cooling function of the freezer compartment remains operational when the one modular unit is removed from the freezer compartment, and the ice generator is indirectly connected to the housing via one of the ice storage container housing and a support member shared with the ice storage container housing.

15. The domestic refrigerator of claim 14, wherein the ice storage container housing receives an ice storage container, and the ice generator is separable from the ice storage container housing with the ice storage container in place in the ice storage container housing.

16. The ice dispenser of claim 1, further comprising a cold-air duct that channels cold air into the ice dispenser, and a diversion feature that diverts a portion of the cold air so that the portion bypasses the ice generator.

17. The ice dispenser of claim 16, wherein the ice generator is separable from the ice storage container housing with the ice storage container in place in the ice storage container housing.

18. The ice dispenser of claim 1, wherein the ice generator is separable from the ice storage container housing with the ice storage container in place in the ice storage container housing.

19. The ice dispenser of claim 1, wherein the ice storage container housing and the ice generator are configured to be simultaneously removable from the freezer compartment of the domestic appliance.

20. The ice dispenser of claim 1, wherein the ice generator includes a depression which intermeshes with a recess of the ice storage housing container.

21. The ice dispenser of claim 3, wherein the cold air duct extends from a support wall and through the ice generator to the ice storage container housing.

22. The ice dispenser of claim 14, wherein the ice storage container housing and the ice generator are configured to be simultaneously removable from the freezer compartment of the domestic refrigerator.

23. The ice dispenser of claim 14, wherein the ice generator includes a depression which intermeshes with a recess of the ice storage housing container.

24. The ice dispenser of claim 14, wherein a cold air duct extends from a support wall and through the ice generator to the ice storage container housing.

* * * * *